US009964916B2

(12) United States Patent
Manabe et al.

(10) Patent No.: US 9,964,916 B2
(45) Date of Patent: May 8, 2018

(54) IMAGE FORMING APPARATUS WITH LIGHT EMITTING SURFACE PROVIDED ON SURFACE THAT DEFINES RECESSED PORTION

(71) Applicant: CANON KABUSHIKI KAISHA, Tokyo (JP)

(72) Inventors: Kenichi Manabe, Toride (JP); Masaki Kakitani, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/422,633

(22) Filed: Feb. 2, 2017

(65) Prior Publication Data

US 2017/0227917 A1 Aug. 10, 2017

(30) Foreign Application Priority Data

Feb. 9, 2016 (JP) ..... 2016-023038

(51) Int. Cl.
*G03G 21/00* (2006.01)
*G03G 21/16* (2006.01)

(52) U.S. Cl.
CPC ..... *G03G 21/1638* (2013.01); *G03G 21/1633* (2013.01); *G03G 2215/0129* (2013.01); *G03G 2221/1675* (2013.01)

(58) Field of Classification Search
CPC ..... G03G 21/1633; G03G 21/1638; G03G 2221/1675
See application file for complete search history.

(56) References Cited

U.S. PATENT DOCUMENTS 5,157,448 A * 10/1992 Lang ..... G03G 15/6502 271/157
5,307,116 A * 4/1994 Ikunami ..... G03G 15/70 271/263
6,089,560 A * 7/2000 Fujiwara ..... B65H 1/266 271/10.11
6,658,218 B2 * 12/2003 Krolczyk ..... B65H 43/00 399/16
7,334,786 B2 * 2/2008 Shinga ..... B65H 1/266 271/145
7,341,247 B2 * 3/2008 Hirata ..... B65H 37/00 270/58.07
8,777,472 B2 * 7/2014 Okada ..... G03G 15/5016 362/551

(Continued)

FOREIGN PATENT DOCUMENTS

JP 2011-011838 A 1/2011

OTHER PUBLICATIONS

Copending, unpublished U.S. Appl. No. 15/416,530 to Masaki Kakitani, dated Jan. 26, 2017.

*Primary Examiner* — David Bolduc
(74) *Attorney, Agent, or Firm* — Fitzpatrick, Cella, Harper & Scinto

(57) ABSTRACT

An image forming apparatus includes an image forming portion configured to form an image on a sheet, a sheet feeding device configured to feed the sheet, an openable member configured to be opened for exposing at least a part of a sheet feeding path of the sheet feeding device to an outside of the image forming apparatus, an operating portion operated for opening the openable member, and an illumination device configured to illuminate the operating portion.

14 Claims, 9 Drawing Sheets

(a) (b)

(56) References Cited

U.S. PATENT DOCUMENTS

| | | | | |
|---|---|---|---|---|
| 9,442,450 | B2 | 9/2016 | Sato et al. | |
| 2003/0170041 | A1* | 9/2003 | Katsuyama | G03G 15/23 399/84 |
| 2007/0014580 | A1* | 1/2007 | Woo | G03G 15/502 399/21 |
| 2012/0274954 | A1* | 11/2012 | Dobinson | B41J 3/46 358/1.9 |
| 2013/0302044 | A1* | 11/2013 | Yoshioka | G03G 21/1695 399/21 |
| 2014/0167580 | A1* | 6/2014 | Funayama | E05C 3/30 312/237 |
| 2014/0167587 | A1* | 6/2014 | Takenaka | G03G 21/1647 312/333 |
| 2014/0169828 | A1* | 6/2014 | Ohta | G03G 15/6502 399/110 |
| 2014/0334834 | A1* | 11/2014 | Katsuyama | G03G 15/70 399/21 |
| 2014/0369046 | A1* | 12/2014 | Andoh | B41J 29/42 362/282 |
| 2016/0103411 | A1 | 4/2016 | Sato et al. | |

* cited by examiner (a) (b)

IMAGE FORMING APPARATUS WITH LIGHT EMITTING SURFACE PROVIDED ON SURFACE THAT DEFINES RECESSED PORTION

FIELD OF THE INVENTION AND RELATED ART

The present invention relates to an image forming apparatus for forming an image on a sheet.

The image forming apparatus includes a sheet feeding device for feeding the sheet (including the sheet before image formation and the sheet after the image formation) on which an image is to be formed by an image forming portion.

The sheet feeding device includes a reversing portion for feeding the sheet in a switchback manner as disclosed in Japanese Laid-Open Patent Application (JP-A) 2011-11838. The reversing portion includes a discharge feeding path, a reverse induction path, a switchback path, and a reverse discharge path. The discharge feeding path is a sheet feeding path for guiding the sheet, on which the image is formed, in order to discharge the sheet from the image forming apparatus. The reverse induction path is a feeding path branching from the discharge feeding path. The switchback path is a sheet feeding path in which the sheet, on which the image is formed, passed through the reverse induction path is pulled in order to turn upside down the sheet and to reverse leading and trailing ends of the sheet with respect to a (sheet) feeding direction. The reverse discharge path is a sheet feeding path, merged with the discharge feeding path, for guiding the sheet pulled in the switchback path in order to discharge the sheet from the image forming apparatus. In the case of the image forming apparatus capable of effecting both-side (double-side) image formation for forming images on the surfaces (sides) of the sheet, the sheet feeding device also includes a both-side feeding path which is a sheet feeding path in which the sheet of which leading and trailing ends with respect to the feeding direction are reversed in the switchback path at the reversing portion is fed.

Incidentally, in the case where a jam generates in the image forming apparatus, removal of the sheet causing the jam (herein also referred to as "jam clearance") is required. For that reason, in some cases, an openable member is provided as a part of the image forming apparatus and the openable member is opened to expose the sheet feeding device and a (sheet) feeding member and then the sheet is removed. For example, in some cases, a rotatable door (reversing door) is provided at a side surface of the image forming apparatus where the sheet is to be discharged, in order to expose the sheet feeding path and the feeding member of the above-described reversing portion.

However, an operation of opening and closing the openable member for the jam clearance or the like is not readily performed in some cases.

SUMMARY OF THE INVENTION

A principal object of the present invention is to provide an image forming apparatus capable of easily carrying out an operation of opening an openable member for jam clearance or the like and is to provide an image forming system including the image forming apparatus.

According to an aspect of the present invention, there is provided an image forming apparatus comprising: an image forming portion configured to form an image on a sheet; a sheet feeding device configured to feed the sheet; an openable member configured to be opened for exposing at least a part of a sheet feeding path of the sheet feeding device to an outside of the image forming apparatus; an operating portion operated for opening the openable member; and an illumination device configured to illuminate the operating portion.

Further features of the present invention will become apparent from the following description of exemplary embodiments with reference to the attached drawings.

DESCRIPTION OF THE EMBODIMENTS

An image forming apparatus and an image forming system according to the present invention will be described with reference to the drawings.

Embodiment 1

1. Image Forming System

Figure 1:
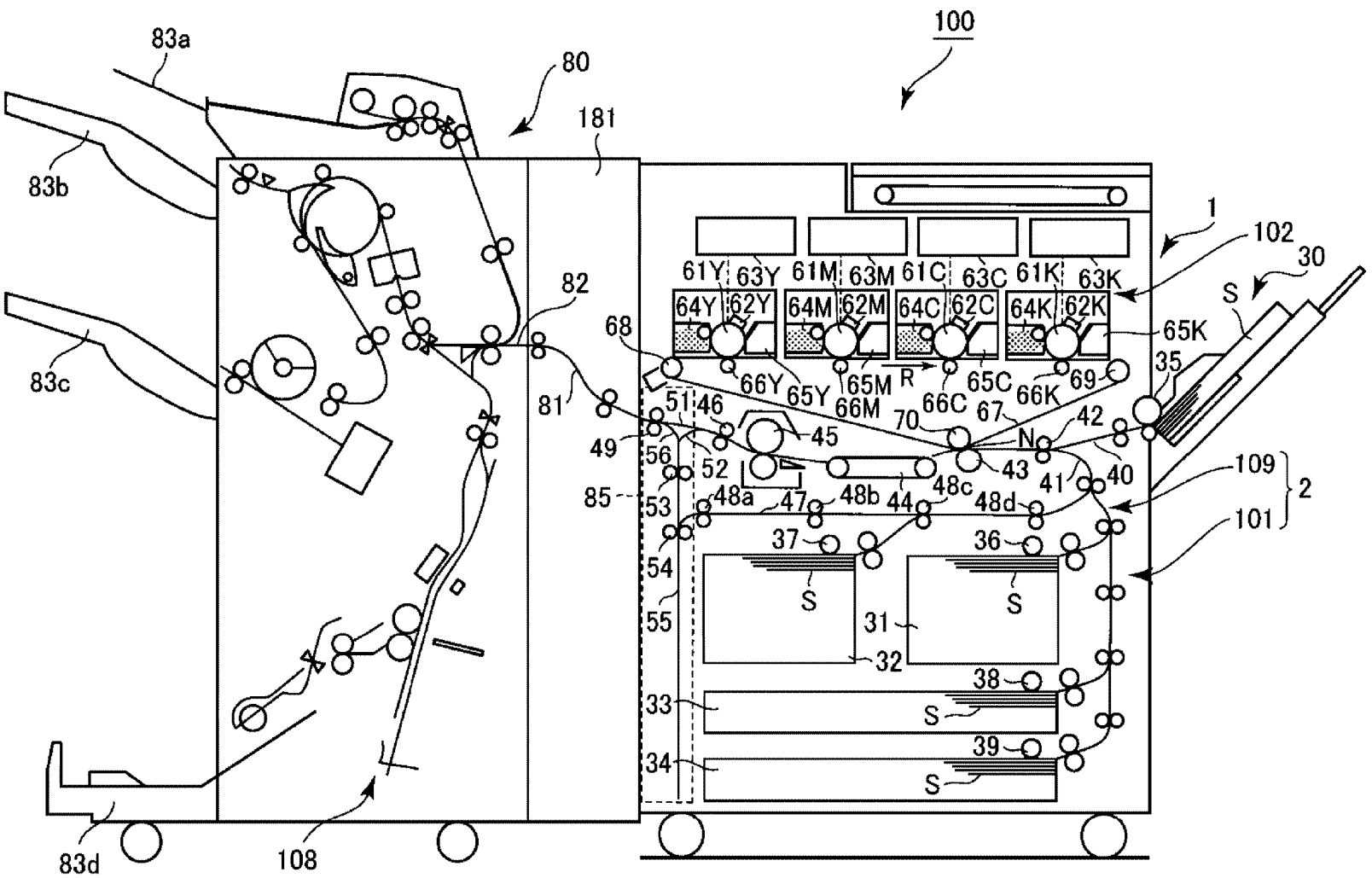
FIG. 1 is a schematic sectional view of an image forming apparatus.
Figure 2:
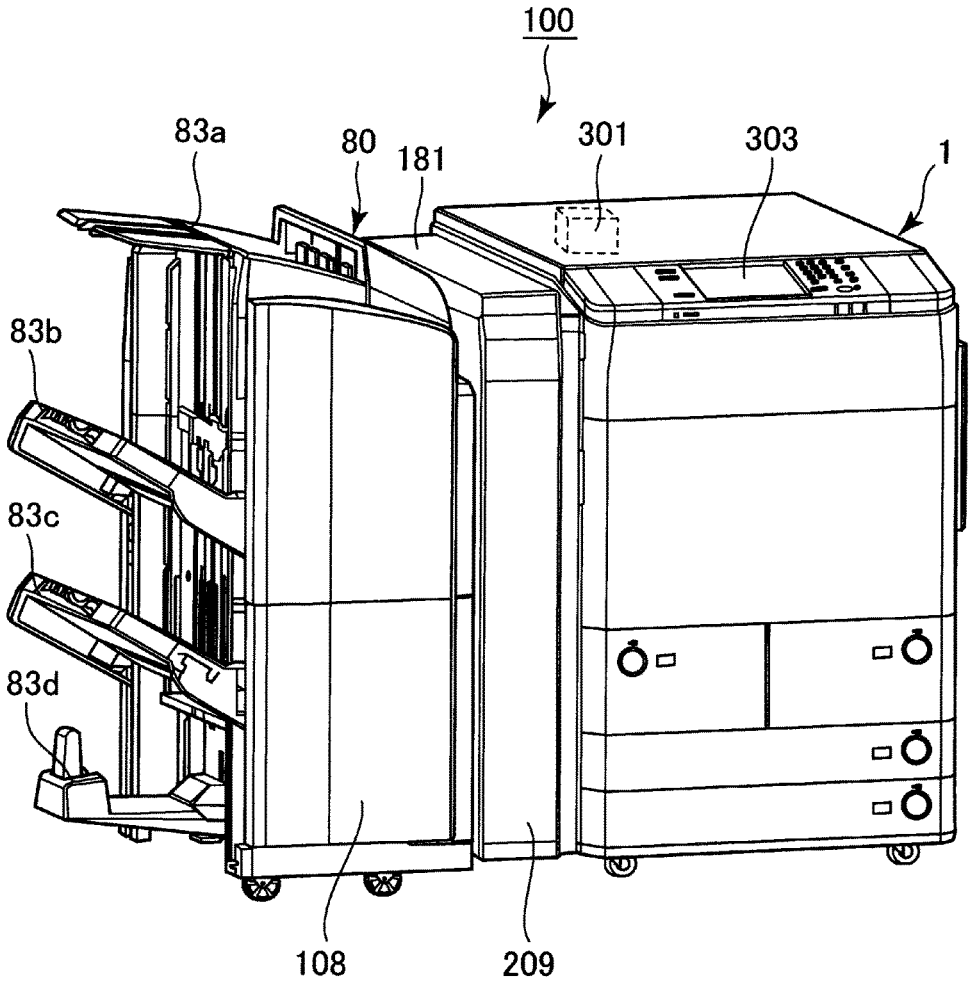
FIG. 2 is a perspective view of the image forming apparatus.

FIG. 1 is a schematic sectional view of an image forming apparatus 100 in this embodiment. FIG. 2 is a perspective view of the image forming apparatus 100.

The image forming apparatus 100 includes a printer 1 as an image forming apparatus main assembly and a finisher 80 as an option unit. In this embodiment, the printer 1 is a color image forming apparatus using an electrophotographic type. Particularly, in this embodiment, from advantages such as compatibility with a wide variety of sheets and excellent print productivity, the printer 1 employs an intermediary transfer tandem type in which image forming units for four colors are provided and disposed on an intermediary transfer belt. Further, in this embodiment, the finisher (post-processing device) 80 has a function of post-processing such as stapling or saddle stitch.

The printer 1 includes a sheet feeding portion 101 for feeding a sheet (recording material, transfer material) S such as a recording sheet and a sheet feeding (conveying) portion 109 for feeding (conveying) the sheet S fed by the sheet feeding portion 101. In this embodiment, a sheet feeding device 2 is constituted by the sheet feeding portion 101 and the sheet feeding portion 109. The printer 1 includes an image forming portion 102 for forming an image on the sheet S fed by the sheet feeding portion 109.

The sheet feeding portion 101 includes sheet accommodating portions 30-34 and sheet feeding members 35-39.

The image forming portion 102 includes photosensitive members 61 (61Y, 61M, 61C, 61K), charging devices 62 (62Y, 62M, 62C, 62K), exposure devices 63 (63Y, 63M, 63C, 63K) and developing devices 64 (64Y, 64M, 64C, 64K). Further, the image forming portion 102 includes primary transfer devices 66 (66Y, 66M, 66C, 66K) and photosensitive member cleaners 65 (65Y, 65M, 65C, 65K). Further, the image forming portion 102 includes an intermediary transfer belt 67 onto which toner images formed on the photosensitive members 61Y, 61M, 61C, 61K are primary-transferred and a secondary transfer roller 43 which is a secondary transfer device for transferring the toner images from the intermediary transfer belt 67 onto the sheet S. The intermediary transfer belt 67 is stretched by rollers as stretching rollers such as a driving roller 68, a tension roller 69 and an inner secondary transfer roller 70 and is rotationally driven (fed) in an arrow R direction (clockwise direction) indicated in FIG. 1. Further, the image forming portion 102 includes a fixing device 45 for fixing an image on the sheet S on which the toner images are transferred.

The sheet feeding portion 109 includes supply feeding paths 40, 41 which are sheet feeding paths through which the sheet S fed by the sheet feeding members 35-39 of the sheet feeding portion 101 pass. Further, the sheet feeding portion 109 includes a registration roller pair 42 for feeding the sheet S to a secondary transfer portion (secondary transfer nip) N which is a contact portion between the intermediary transfer belt and the secondary transfer roller 43. Further, the sheet feeding portion 109 includes a pre-fixing feeding belt 44 for sending the sheet S, on which the toner images are transferred, to the fixing device 45. Further, the sheet feeding portion 109 includes a reversing portion 85, for feeding the sheet in a switchback manner, provided downstream of the fixing device 45 with respect to a (sheet) feeding direction of the sheet S.

The reversing portion 85 includes a discharge feeding path 51, a reverse induction path 52, a switchback path 55 and a reverse discharge path 56. The discharge feeding path 51 is a sheet feeding path for guiding the sheet S, on which the image is formed, in order to discharge the sheet S from the printer 1. The reverse induction path 52 is a sheet feeding path branching from the discharge feeding path 51. The switchback path 55 is a sheet feeding path in which the sheet S passed through the reverse induction path 52 is pulled (drawn) for turning upside down the sheet S and reversing leading and trailing ends of the sheet S with respect to the feeding direction. The reverse discharge path 56 is a sheet feeding path, merged with the discharge feeding path 51, for guiding the sheet S, pulled in the switchback path 55, to be discharged from the printer 1. Further, the reversing portion 85 includes an upper reversing roller pair 53 and a lower reversing roller pair 54 which are feeding members provided along the switchback path 55. Further, the reversing portion 85 includes an inner discharging roller pair 46 and an outer discharging roller pair 49 which are feeding members for feeding the sheet S discharged from the fixing device 45.

Further, the sheet feeding portion 109 includes a both-side (double-side) feeding path 47 which is a sheet feeding path for feeding the sheet S reversed in feeding direction in the switchback path 55 of the reversing portion 85. The both-side feeding path 47 connects with the supply feeding path 41. Further, the sheet feeding portion 109 includes both surface roller pairs 48*a*-48*d* which are feeding members for feeding the sheet S passing through the both-side feeding path 47.

Further, the printer 1 is provided with an operating screen 303. The operating screen 303 not only functions as a display device for displaying information on the printer 1 but also functions as an inputting for inputting various setting values into the printer 1.

On the other hand, the finisher 80 includes a buffer path unit 181 for feeding the sheet S discharged from the printer 1 and a post-processing unit (finisher main assembly) 108 for processing the sheet S fed by the buffer path unit 181. The buffer path unit 181 includes a buffer path 81 which is a sheet feeding path for guiding the sheet S to be fed to the post-processing unit 108. The buffer path 81 is connected with the discharge feeding path 51 of the printer 1 in a downstream side with respect to the feeding direction of the sheet S. Further, the finisher 80 includes discharge stacking portions 83*a*-83*d* onto which the sheet S processed by the post-processing unit 108 is discharged. Incidentally, the buffer path unit 181 and the post-processing unit 108 are individual units, and the printer 1 may also be connected with the post-processing unit 108 via the buffer path unit 181.

2. Sheet Feeding Process

The sheet S is accommodated in the sheet accommodating portions 30-34 in a stacked manner and is fed by the respective sheet feeding portions 35-39 in synchronism with image forming timing in the image forming portion 102. The sheet S fed by the respective sheet feeding portions 35-39 passes through the respective sheet feeding paths 40, 41 and is fed to the registration roller pair 42.

The fed sheet S is abutted against the registration roller pair 42 and forms a loop thereof. As a result, a leading end of the sheet S follows the registration roller pair 42, so that oblique movement of the sheet S is corrected. Further, the registration roller pair 42 sends, after correcting the oblique movement of the sheet S, the sheet S to the secondary transfer portion N at predetermined timing in synchronism with image forming timing on the sheet S. That is, the registration roller pair 42 feeds the sheet S to the secondary transfer portion N in synchronism with timing when the toner images carried on the intermediary transfer belt 67 which is an image bearing member reaches the secondary transfer portion N.

The secondary transfer portion N is a nip which is formed by the inner secondary transfer roller 70 and the secondary transfer roller 43 disposed opposed to each other via the intermediary transfer belt 67 and where the toner images are to be transferred onto the sheet S. At the secondary transfer portion N, the toner images are transferred (secondary-transferred) onto the sheet S by applying predetermined pressure and a predetermined electrostatic load bias.

3. Image Forming Process

An image forming process carried out at the same timing as the sheet feeding process to the secondary transfer portion N described above will be described. The surface of the rotating photosensitive member 61 is electrically charged uniformly by the charging device 62. The surface of the charged photosensitive member 61 is subjected to scanning exposure by the exposure device 63. The exposure device 63 is driven on the basis of a sent image information signal. As a result, an electrostatic latent image (electrostatic image) is formed on the photosensitive member 61. The electrostatic latent image formed on the photosensitive member 61 is positioned (visualized) with toner as a developer by the developing device 64. As a result, the toner image is formed on the photosensitive member 61. The toner image on the photosensitive member 61 is transferred (primary-transferred) onto the intermediary transfer belt 67 by applying predetermined pressure and a predetermined electrostatic load bias by the primary transfer device 66. Toner (transfer residual toner) remaining on the photosensitive member 61 in a slight amount after a primary transfer step is removed and collected from the surface of the photosensitive member 61 by the photosensitive member cleaner 65.

During formation of a full-color image, the above-described image forming process is performed for each of the colors of yellow (Y), magenta (M), cyan (C) and block (K). Then, the toner images of the respective colors of Y, M, C and K formed on the respective photosensitive members 61 are transferred superposedly onto the intermediary transfer belt 67. As a result, the toner images for the full-color image are formed on the intermediary transfer belt 67.

Incidentally, the printer 1 is also capable of forming a monochromatic image of a single color such as black.

4. Processes of Secondary Transfer and Later

As described above, at the secondary transfer portion N, the toner images are transferred (secondary-transferred) from the intermediary transfer belt 67 onto the sheet S. Thereafter, the sheet S is fed to the fixing device 45 by the pre-fixing feeding belt 44. The fixing device 45 fixes (melt-fixes) the toner images on the sheet S by predetermined pressure (urging force) by rollers or belts provided opposed to each other and by heat of a heat source such as a heater.

The sheet S on which the image is fixed is fed to the discharge feeding path 51 or the reverse induction path 52 by the inner discharging roller pair 46. At a branching portion between the discharge feeding path 51 and the reverse induction path 52, a switching device (not shown) for selectively switching the sheet feeding path of the sheet S is provided. When the sheet S is discharged from the printer 1, the discharge feeding path 51 is selected. In the case where the sheet S is turned upside down or leading and trailing ends of the sheet S are reversed and the sheet S is discharged from the printer 1 or in the case where the image is formed on a second surface in both-surface image formation, the reverse induction path 52 is selected.

The sheet S fed in the discharge feeding path 51 by the inner discharging roller pair 46 is discharged from the printer 1 by the outer discharging roller pair 49. With the discharge feeding path 51, the buffer path 81 provided in the buffer path unit 181 of the finisher 80 is connected. The sheet S fed by the outer discharging roller pair 49 is sent to the post-processing unit 108 via the buffer path 81 and is subjected to post-processing by the post-processing unit 108 as desired. Then, finally, the sheet S is discharged onto the discharge stacking portions 83*a*-83*d*.

In the case where the image is formed on the second surface in the both-surface image formation, the sheet S fed in the reverse induction path 52 is pulled into the switchback path 55 by the upper reversing roller pair 53 and the lower reversing roller pair 54. The leading and trailing ends of the sheet S pulled in the switchback path 55 are reversed with respect to the feeding direction by switching a rotational direction of the lower reversing roller pair 54 to an opposite direction to that during the pulling-in of the sheet S (switching operation). Then, the sheet S is fed to the both-side feeding path 47 by the lower reversing roller pair 54. Thereafter, the sheet S is fed in the both-side feeding path 47 by the both-surface roller pairs 48*a*-48*d* and is merged with the feeding path 41 while ensuring timing of a subsequent sheet S fed by the respective sheet feeding members 35-39. Then, the sheet S is fed to the secondary transfer portion N through the registration roller pair 42. As regards the image forming process on the back surface (second surface), the process is the same as that in the according to case of the front surface (first surface) and therefore will be omitted from description.

In the case where the sheet S is discharged from the printer 1 after being turned upside down and after the leading and trailing ends of the sheet S are reversed, similarly as in the case where the image is formed on the second surface in the both-surface image formation, the sheet S is pulled from the reverse induction path 52 into the switchback path 55. Thereafter, the rotational direction of the upper reversing roller pair 53 and the lower reversing roller pair 54 is switched to an opposite direction to that during the pulling-in of the sheet S, whereby the sheet S is turned upside down and the leading and trailing ends thereof with respect to the feeding direction are reversed, so that the sheet S is discharged from the switchback path 55. The sheet S is discharged from the printer 1 by the outer discharging roller pair 49 via the reverse discharge path 56, and then is sent to the buffer path 81 of the finisher 80 in the same manner as described above.

5. Constitution for Jam Clearance at Reversing Portion

A constitution for removing the sheet stagnating at the reversing portion 85 in the case where a jam generated will be described.

Figure 3:
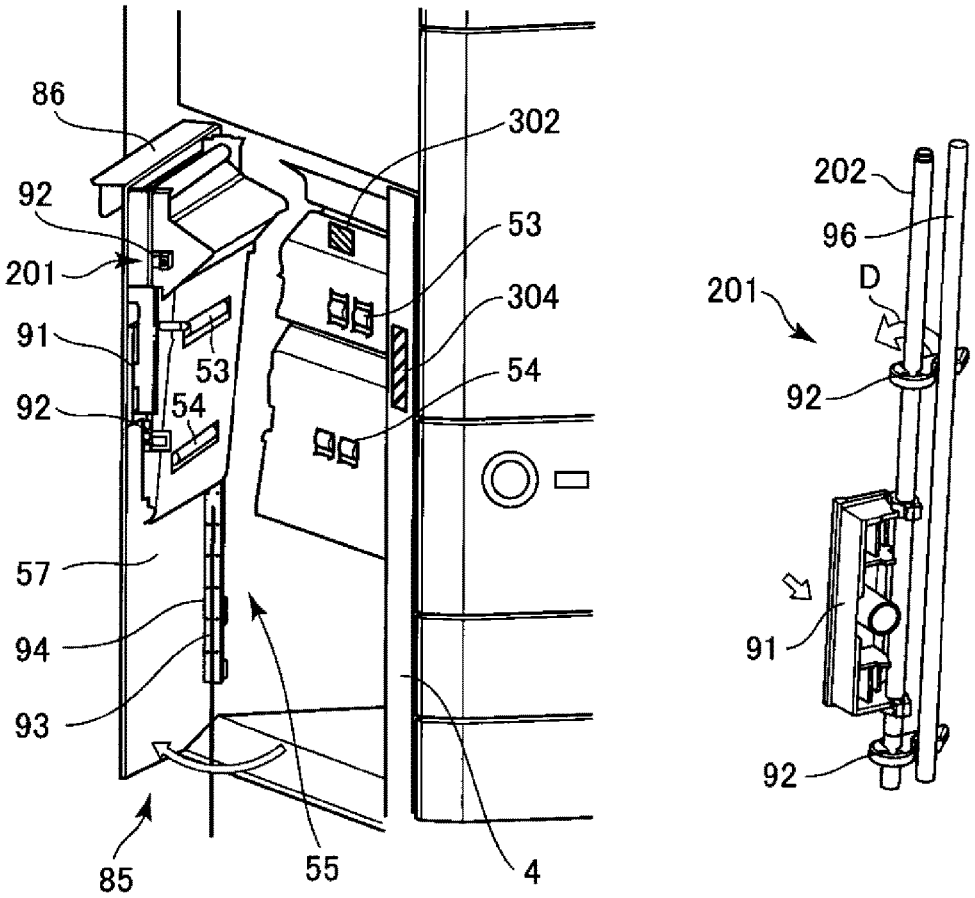
In FIG. 3, (a) is a perspective view of a reversing door and a neighborhood thereof, and (b) is a perspective view of a locking mechanism of the reversing door.

In FIG. 3, (a) is a perspective view of the reversing portion 85 and a neighborhood thereof. In (a) of FIG. 3, for easy understanding of a constitution of the reversing portion 85, the finisher 80 is omitted from illustration.

Incidentally, as regards the image forming apparatus 100 (printer 1, finisher 80), a front side (surface) on the drawing sheet of FIG. 1 is a "front side (front surface)" and a rear side (surface) on the drawing sheet of FIG. 1 is a "rear side (rear surface)". This front-rear direction is substantially parallel to rotational axis directions of the photosensitive members 61 and the stretching rollers 68-70 for the intermediary transfer belt 67. In the front side of the printer 1, the operating screen 303 is provided, and an operator such as a user or a service representative usually carries out an operation of the image forming apparatus 100 from the front side of the printer 1. Further, as regards the image forming apparatus 100 (printer 1, finisher 80), a left-right direction is a left-right direction when the image forming apparatus 100 is seen from the front side. In general, the image forming apparatus 100 is provided and used so that the front-rear direction is a substantially horizontal direction (substantially perpendicular to a gravitational direction). Further, an up-down direction is an up-down direction with respect to the gravitational direction (vertical direction) but does not mean only right (just) above and right (just) below, but includes an upper side and a lower side with respect to a horizontal surface passing through an objective element or position.

In the left side of the printer 1, i.e., at a side surface adjacent to the reversing portion 85, a reversing door 57 as an openable member is provided so that the sheet feeding paths and the feeding members at the reversing portion 85 can be exposed. The reversing door 57 is an example of the openable member for exposing at least a part of the sheet feeding path, for guiding the sheet S in the sheet feeding device 2, to an outside of the printer 1. The reversing door 57 is supported by an apparatus main assembly (frame) 4 of the printer 1 so as to be rotatable by a hinge portion 94 provided in the rear side of the printer 1. In this embodiment, the reversing door 57 rotates about a rotation center (rotation axis) 93 disposed so as to extend in a substantially gravitational direction of the hinge portion 94. That is, the reversing door 57 rotates in the substantially horizontal direction about a rotation center 93 positioned in the rear side of the printer 1.

The reversing door 57 holds one roller of the upper reversing roller pair 53 and one roller of the lower reversing roller pair 54. An inner surface of the reversing door 57 constitutes a feeding guide surface (guide member) which forms the switchback path 55 and the reverse induction path 52. Thus, in this embodiment, the sheet feeding device 2 includes, as the sheet feeding path, a first path for discharging the sheet S on which the image is formed by the image forming portion 102. Further, in this embodiment, the sheet feeding device 2 includes, as the sheet feeding path, a second path in which the sheet S on which the image is formed by the image forming portion 102 is pulled for being turned upside down and for reversing the leading and trailing ends thereof with respect to the feeding direction and which branches from the first path. In this embodiment, the discharge feeding path 51 and the reverse discharge path 56 constitute the first path. Further, in this embodiment, the reverse induction path 52 and the switchback path 55 constitute the second path. Further, in this embodiment, the reversing door 57 as the openable member forms at least a part of the above-described second path.

As shown in (a) of FIG. 3, by rotating the reversing door 57 to open, it is possible to not only space the rollers, from each other, constituting each of the upper reversing roller pair 53 and the lower reversing roller pair 54 but also open the reverse induction path 52 and the switchback path 55. Further, thus by rotating the reversing door 57 to open, a state in which the sheet S stagnating in the discharge feeding path 51, the reverse induction path 52, the switchback path 55, the reverse discharge path 56 or the both-side feeding path 47 can be removed (jam clearance) is formed.

The reversing door 57 includes a locking mechanism 201 for locking the reversing door 57 at a closed position. The locking mechanism 201 includes, as shown in (a) of FIG. 3, a hook shaft 202 provided rotatably about the reversing door 57, and a hook 92 and a grip 91 which are fixed to the hook shaft 202. The hook 92 locks the reversing door 57 at a closed position by being engaged with a positioning pin 96 provided on the apparatus main assembly 4. The grip 91 is disposed inside the recessed portion 57*a* (FIG. 6) provided on the reversing door 57 and is exposed to an outside of the reversing door 57. The hook 92 can be disengaged from the positioning pin 96 by rotating the hook shaft 202 in a disengaging direction indicated by an arrow D in (b) of FIG. 3 by operating the grip 91 by the operator. That is, when the reversing door 57 is opened, the locking of the hook 92 is released (eliminated) by operating the grip 91 as the operating portion by the operator. On the other hand, when the reversing door 57 is closed, the hook 92 is automatically engaged with the positioning pin 96, so that locking is made.

Figure 4:
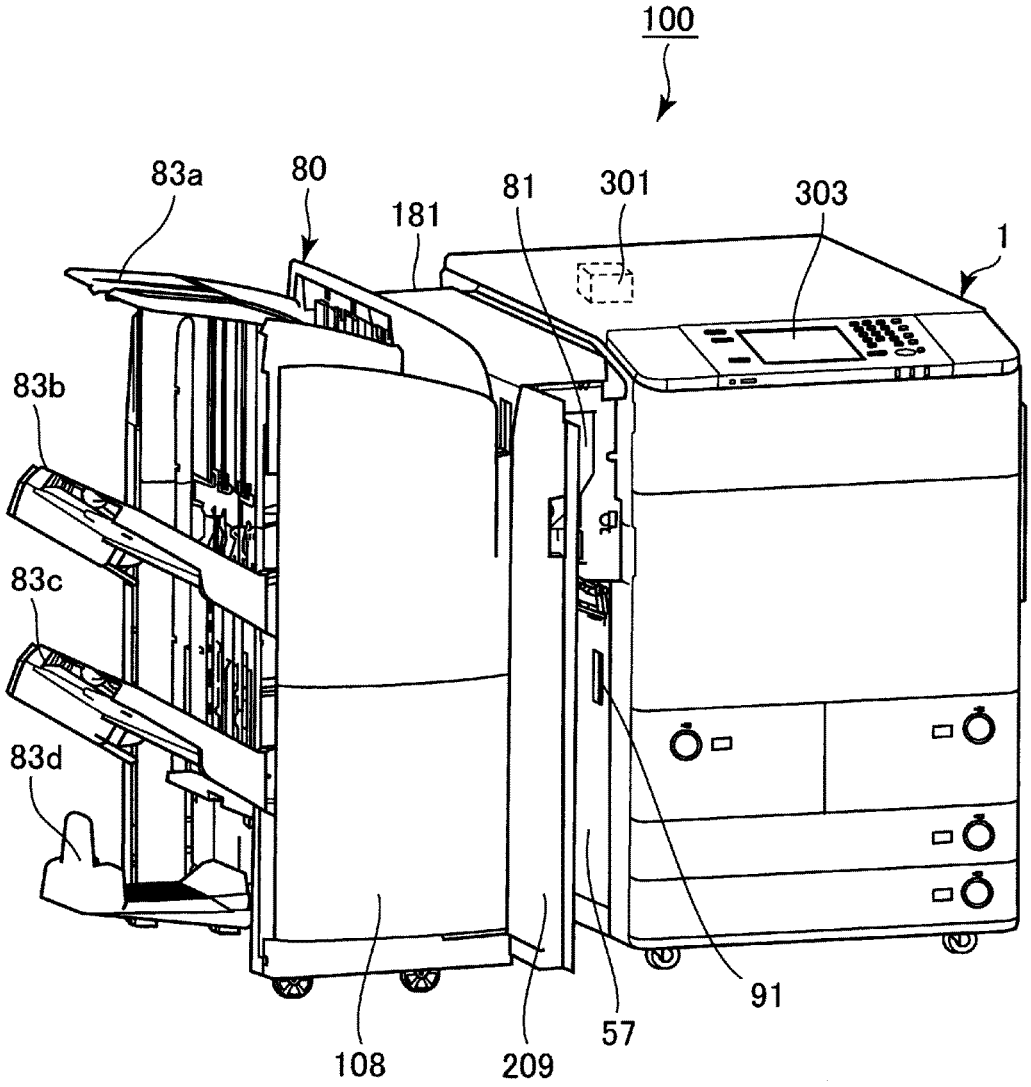
FIG. 4 is a perspective view of the image forming apparatus during an operation of the reversing door.

Here, an opening operation of the reversing door 57 for performing the jam clearance is carried out in a state in which a front-side outer casing 209 provided on the buffer path unit 181 of the finisher 80 as shown in FIG. 4. At this time, at an upper portion of the reversing door 57, the buffer path 81 is disposed, and in the left side of the reversing door 57, the post-processing unit 108 is disposed. The rear side of the buffer path unit 181 is covered with a side plate and an outer casing (which are not shown). Thus, in this embodiment, even in a state in which the finisher 80 is mounted to the printer 1, the reversing door 57 is openably maintained. However, due to existence of elements of the finisher 80 at positions above and in the left side of the reversing door 57, light only enters the periphery (space in which opening/closing of the reversing door 57 is effected) of the reversing door 57 substantially from the front side.

Figure 5:
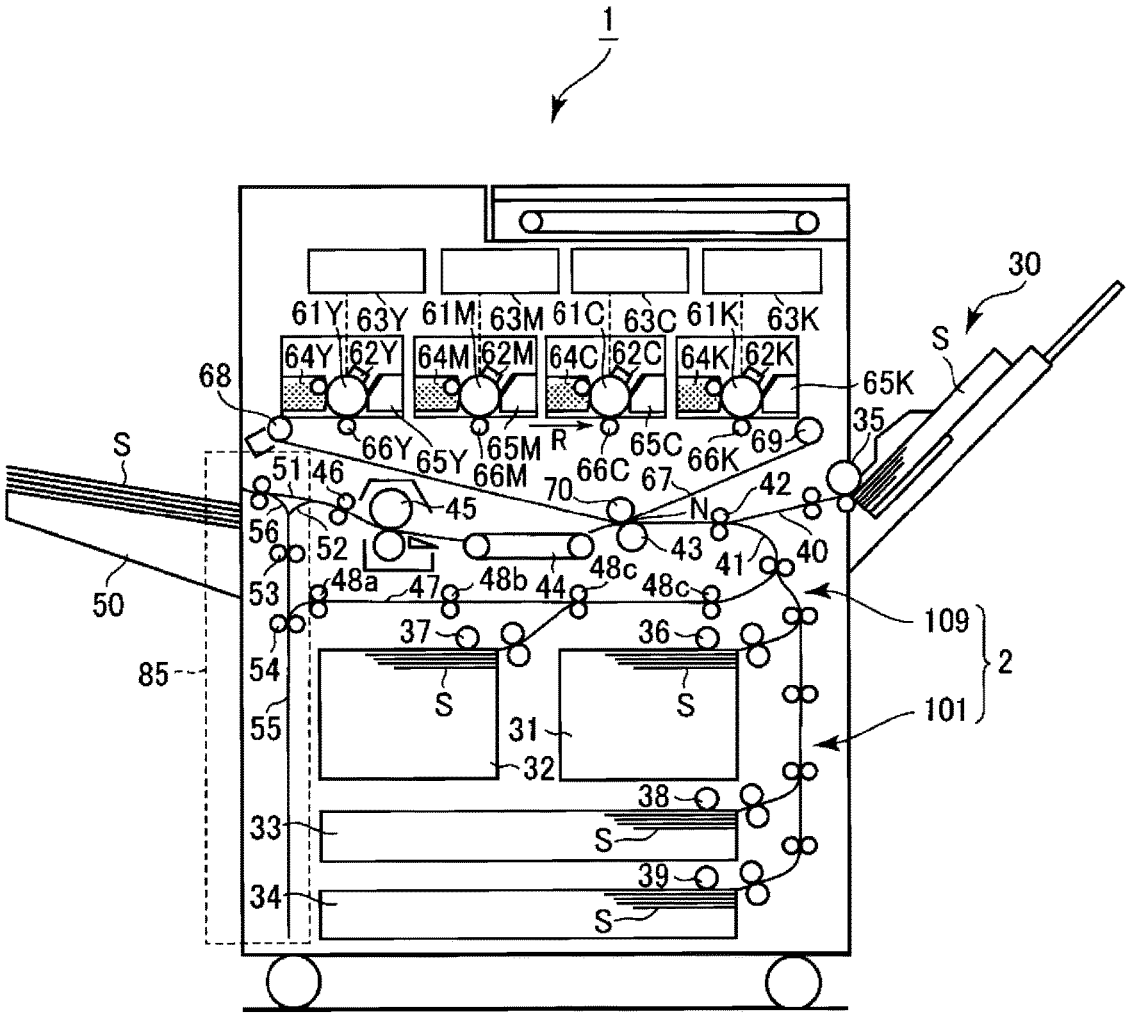
FIG. 5 is a schematic sectional view of the image forming apparatus to which a finisher is not mounted.

On the other hand, as shown in FIG. 5, when the finisher 80 is not mounted to the printer 1, the sheet S on which the image is formed is discharged onto a discharge tray 50 provided at a side surface adjacent to the reversing portion 85 of the printer 1. In this state, at the periphery of the reversing door 57, there is substantially no member which blocks the light, and therefore, the space, in which opening/closing is effected, of the reversing door 57 is adequately lighted.

That is, in this embodiment, the finisher 80 for receiving the sheet S from the sheet feeding device 2 can be arbitrarily mountable to the printer 1. Further, the reversing door 57 of the printer 1 is openable in a state in which the finisher 80 is mounted to the printer 1. Further, when a state of ambient light at a periphery of the image forming apparatus 100 is substantially the same, the reversing door 57 is disposed at a position darker in a state in which the finisher 80 is mounted to the printer 1 than in a state in which the finisher 80 is not mounted to the printer 1.

Here, in this embodiment, in a state in which the finisher 80 is mounted to the printer 1, the post-processing unit 108 exists in a left side of the reversing door 57, and therefore the opening/closing angle (rotatable angle) is limited to about 30 degrees, so that the open space of the reversing door 57 becomes narrow. On the other hand, in a state in which the finisher 80 is not mounted to the printer 1, the reversing door 57 can be opened in the horizontal direction by about 90 degrees.

6. Illumination (Lighting) Device

Figure 6:
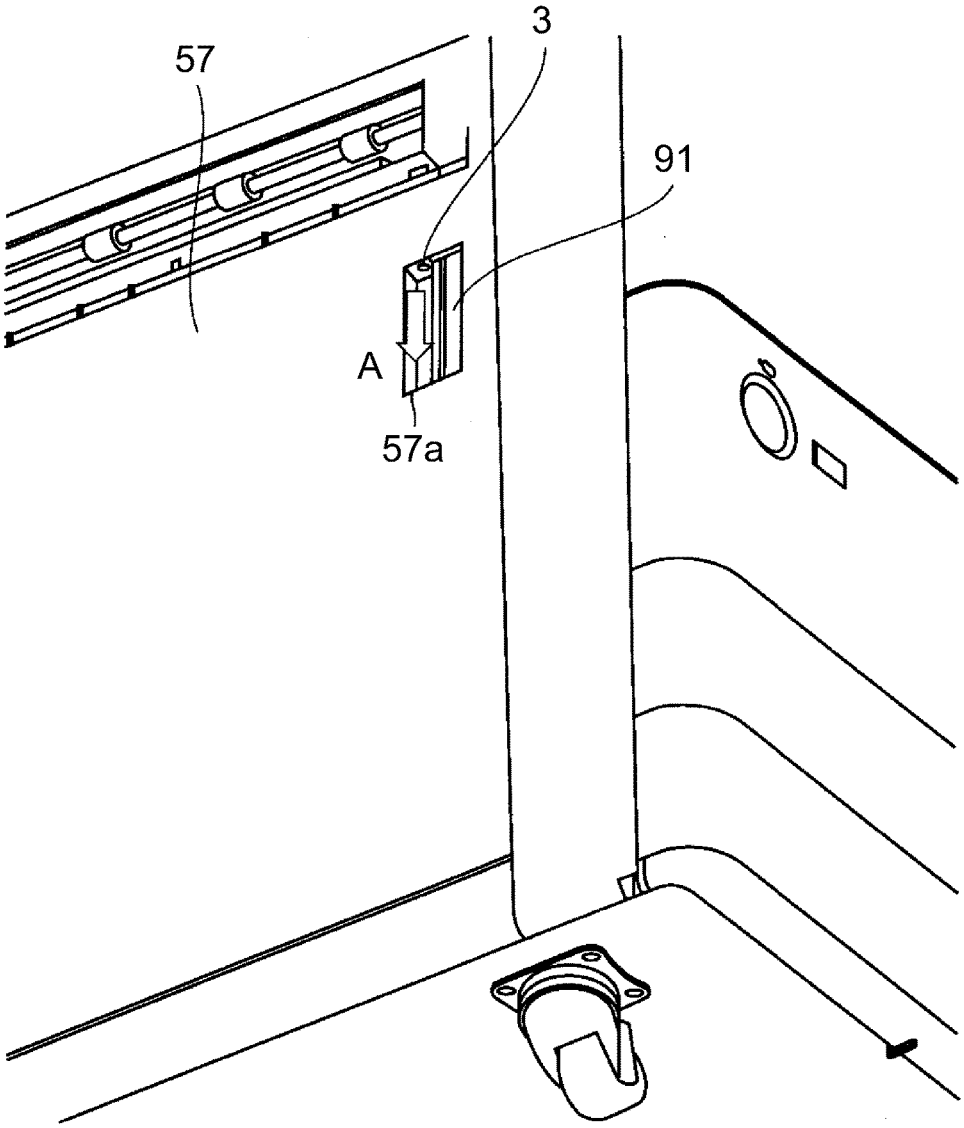
FIG. 6 is a perspective view of the reversing door and the neighborhood thereof.

An illumination (lighting) device for illuminating (lighting) the grip 91 in this embodiment will be described. FIG. 6 is an enlarged perspective view of the periphery of the reversing door 57.

As described above, there is a need to operate the grip 91 when the reversing door 57 is opened. However, in the state in which the finisher 80 is mounted to the printer 1, only the light from the front side enters the periphery of the reversing door 57, and therefore, the operator does not readily recognize the position of the grip 91. That is, in the state in which the finisher 80 is mounted to the printer 1, the reversing door 57, specifically the periphery of the grip 91 operated when the reversing door 57 is opened is partly surrounded by the finisher 80 and therefore becomes dark, so that the viewability of the grip 91 becomes worse. As a result, a jam clearance method is not readily carried out.

Therefore, in this embodiment, as shown in FIG. 6, the printer 1 is provided with an illumination device 3, provided on the reversing door 57, for illuminating the grip 91.

In this embodiment, as regards the illumination device 3 which is a light emitting portion, as a light source, an LED lighting device using an LED (light-emitting diode) is used. The light source of the illumination device 3 is not limited to the LED (lighting device), but may also be an incandescent lamp, a fluorescent lamp or the like. However, from the viewpoints of low electric power consumption, a relatively small size and the like, the LED may preferably be used.

In this embodiment, the grip 91 is disposed inside the recessed portion 57*a* provided on the reversing door 57. Further, in this embodiment, the illumination device 3 is disposed above the grip 91 in the recessed portion 57*a* and illuminates the grip 91 by illuminating an inside of the recessed portion 57*a*.

By turning on the illumination device 3, the grip 91 and the periphery thereof are lighted, so that the position of the grip 91 can be clarified. Accordingly, the operator can easily recognize the grip 91.

In this embodiment, as shown in FIG. 6 by an arrow A, the illumination device 3 emits the light downward. The grip 91 is disposed at a position where the grip 91 receives the light emitted downward by the illumination device 3. Incidentally, the illumination direction of the light of the illumination device 3 is a direction of the light directly emitted from the illumination device 3. The downward illuminating direction means that an amount of the light directly emitted downward is larger than an amount of the light directly emitted upward with respect to the position where the illumination device 3 is provided, and typically, the light directly emitted upward is not required to exist. In this embodiment, the illumination device 3 is provided on an inner wall in an upper side of the recessed portion 57*a*, and substantially emits the light only downward.

In this embodiment, the grip 91 is disposed below the operating screen 303. That is, in this embodiment, the grip 91 is disposed is a lower side (e.g., at a height of about 50 cm from an installation sheet of the printer 1) with respect to the eye level of the operator for operating the grip 91. For that reason, in the case where the illumination direction of the light of the illumination device 3 is the upward direction, it would be considered that the light from the illumination device 3 enters the eye level of the operator and thus the operator does not readily visually recognize the grip 91. On the other hand, in this embodiment, the illumination direction of the light of the illumination device 3 is the downward direction, and therefore the light from the illumination device 3 does not enter the eye level of the operator. As a result, the viewability of the grip 91 can be improved.

7. Sequence of Turning-on of Illumination Device

Figure 7:
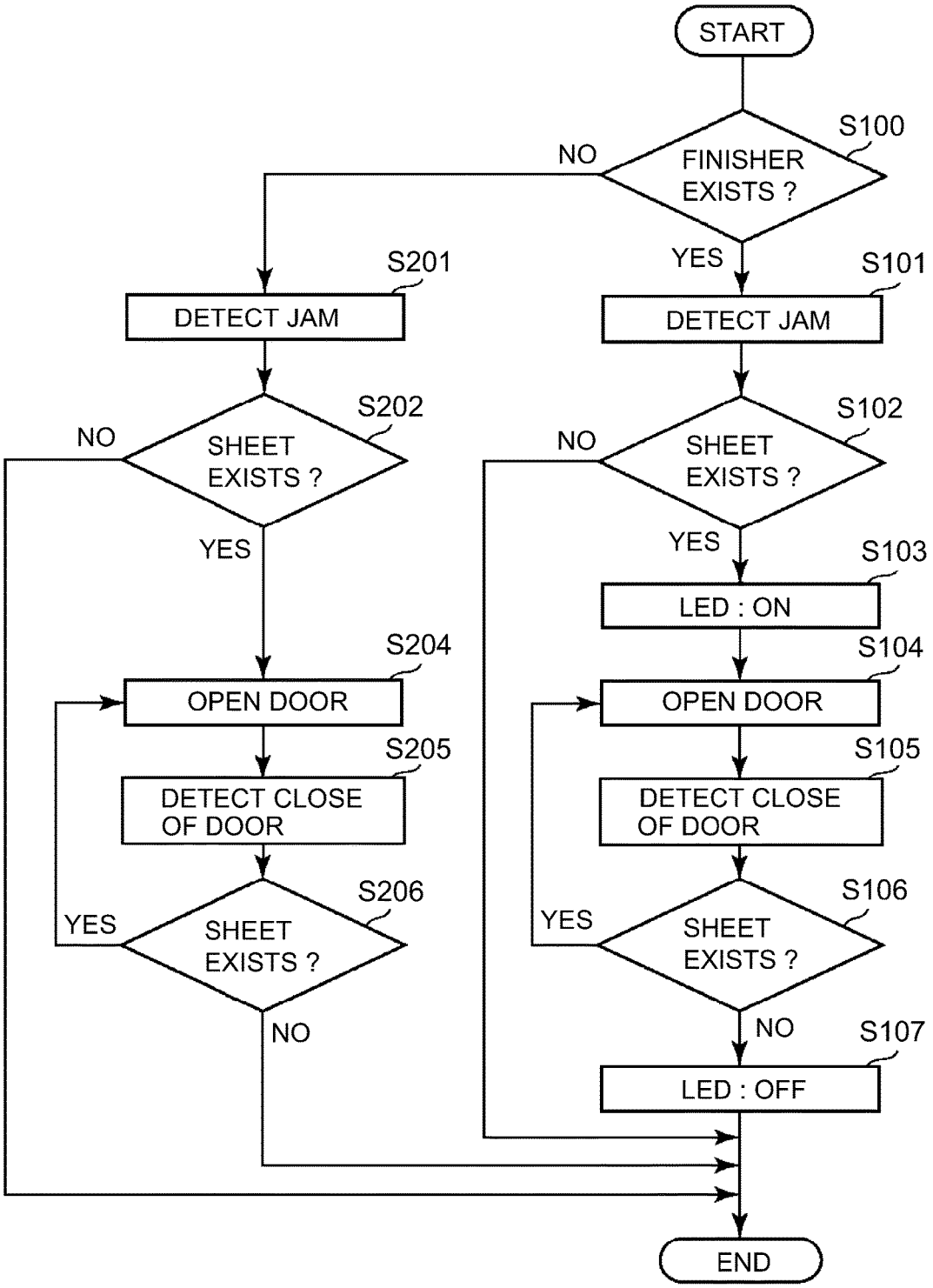
FIG. 7 is a flowchart of control of turning-on and turning-off of an illumination device (lighting device).

A control flow of turning-on and turning-off of the illumination device 3 will be described with reference to FIG. 7. This control is executed by CPU 301 (FIG. 2) as a controller incorporated in the printer 1.

First, the CPU 301 discriminates the presence or absence of the finisher 80 (S301). The CPU 301 can discriminate the presence or absence of the finisher 80 by, e.g., the presence or absence of communication with the finisher 80. After the CPU 301 discriminated that the finisher 80 is presents (exists), when a jam detection signal is inputted (S101), the CPU 301 discriminates whether or not the sheet S exists at the reversing portion 85 (S102). The jam detection signal is inputted into the CPU 301 from, for example, a device, monitoring discharge timing of the sheet S, as a jam detecting means. Further, the CPU 301 discriminates the presence or absence of the sheet S at the reversing portion 85 on the basis of an output of a sheet presence/absence sensor 302 (FIG. 3) as a sheet presence/absence detecting means provided at the reversing portion 85. In the case where the CPU 301 discriminated that the sheet S does not exist (present) at the reversing portion 85, the CPU 301 ends a process (sequence) since there is no need to carry out the jam clearance at the reversing portion 85. On the other hand, the CPU 301 discriminated that the sheet S exists at the reversing portion 85, the CPU 301 turns on the illumination device 3 (S103) and displays an instruction to open the reversing door 57 on the operating screen 303 (S104). After the jam clearance, when the closing of the reversing door 57 is detected by an opening/closing sensor 304 ((a) of FIG. 3) as an opening/closing detecting means provided on the apparatus main assembly 4 (S105), the CPU 301 discriminates the presence or absence of the sheet S at the reversing portion 85 again (S106). Then, when the sheet S is removed, the CPU 301 turns off the illumination device 3 (S107) and ends the process.

Further, after the CPU 301 discriminated that there was no finisher 80 in S100, when the jam detection signal is inputted (S201), on the basis of an output of the sheet pressure/absence sensor 302, the CPU 301 discriminates whether or not the sheet S exists at the reversing portion 85 (S202). In the case where the CPU 301 discriminated that the sheet does not exists at the reversing portion 85, there is no need to perform the jam clearance at the reversing portion 85 and therefore the CPU 301 ends the process. On the other hand, in the case where the CPU 301 discriminated that the sheet exists at the reversing portion 85, the CPU 301 causes the operating screen 303 to display an instruction to open the reversing door 57 (S204). After the jam clearance, when the closing of the reversing door 57 is detected by the opening/closing sensor 304 (S205), the CPU 301 discriminates the presence or absence of the sheet S at the reversing portion 85 again (S206). Then, when the sheet S is removed, the CPU 301 ends the process.

Thus, in this embodiment, in the case where the finisher 80 is mounted to the printer 1, the illumination device 3 is capable of being turned on, and when the finisher 80 is not mounted to the printer 1, the illumination device 3 is not turned on. This is because in this embodiment, when the finisher 80 is mounted to the printer 1, the periphery of the grip 91 of the reversing door 57 becomes dark, but when the finisher 80 is not mounted to the printer 1, the periphery of the grip 91 of the reversing door 57 is light enough in general.

Incidentally, the illumination device 3 may also be capable of being turned on irrespective of whether or not the finisher 80 is mounted to the printer 1.

Further, the illumination device 3 may also be capable of being manually turned on as desired by a switch separately provided at the operating screen 303 or the like.

As described above, according to this embodiment, the printer 1 includes the illumination device 3 for illuminating the grip 91 of the reversing door 57 opened and closed for the jam clearance. As a result, the positions of the reversing door 57 and the grip 91 are clarified, so that operativity when the reversing door 57 is opened can be improved. Further, according to this embodiment, in the case where the grip 91 is in a lower side of the eye level of the operator, the illumination direction of the light of the illumination device 3 is made downward. Thus, the illumination direction is determined so that the light from the illumination device 3 is not emitted toward the eye level of the operator, so that the viewability of the grip 91 can be improved.

Embodiment 2

Another embodiment of the present invention will be described. An image forming system (image forming apparatus and finisher) in this embodiment has the same basic constitution and operation as those in Embodiment 1. Accordingly, in this embodiment, elements having the same or corresponding functions or constitutions as those in Embodiment 1 are represented by the same reference numerals or symbols and will be omitted from detailed description.

Figure 8:
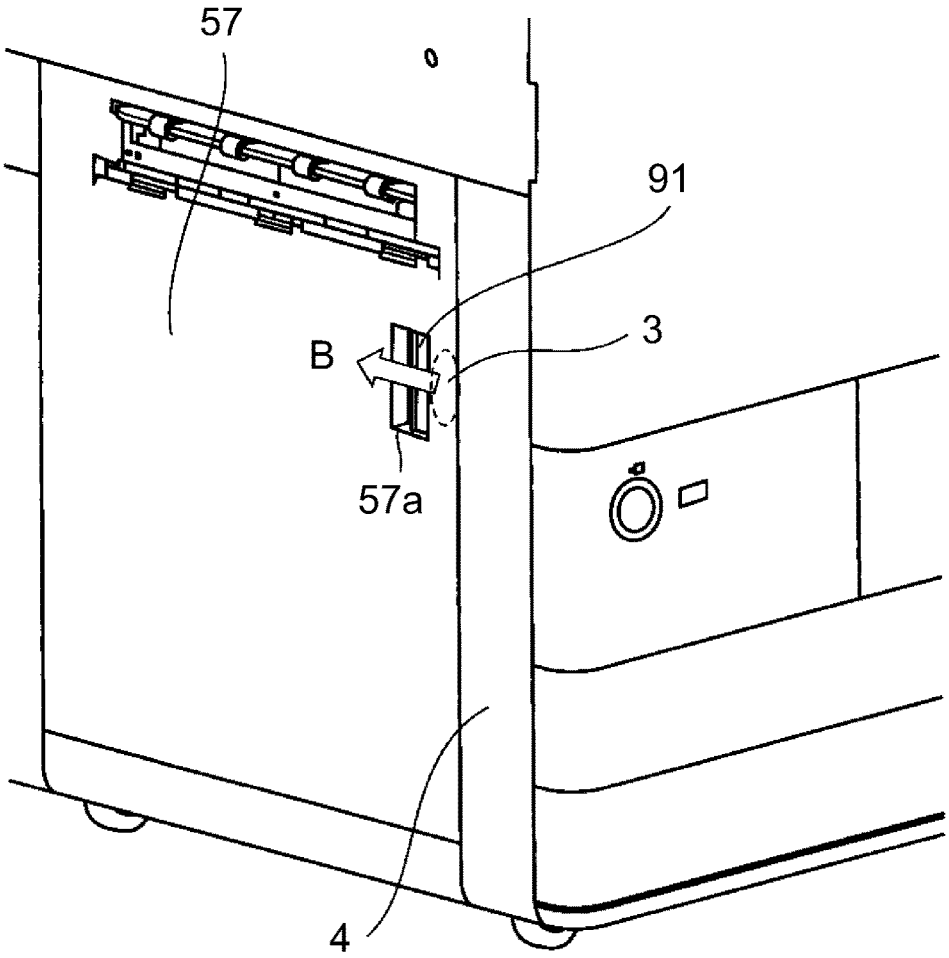
FIG. 8 is a perspective view showing the reversing door and the neighborhood thereof in another embodiment.

FIG. 8 is a perspective view of the reversing door 57 and a neighborhood thereof in this embodiment. Further, FIG. 9 is a perspective view of the reversing door 57 as seen from a back side (inside of the apparatus main assembly 4).

Figure 9:
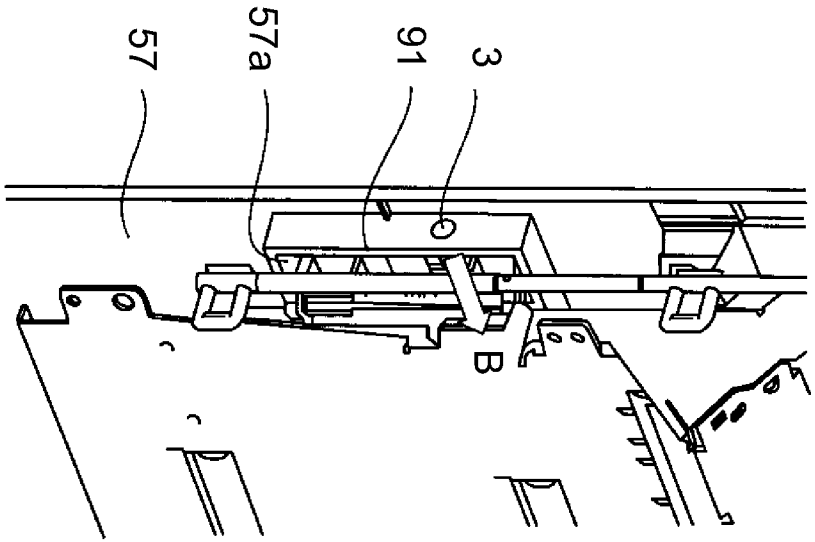
FIG. 9 is a perspective view of the reversing door in another embodiment as seen from a back side.

As shown in FIGS. 8 and 9, the illumination device 3 is provided in a front side than the grip 91 in the recessed portion 57*a* of the reversing door 57. In this embodiment, as shown by an arrow B in FIGS. 8 and 9, the illumination device 3 emits the light from the front side toward a rear side. The illumination direction in which the light is emitted toward the rear side means that an amount of the light directly emitted toward the rear side is more than an amount of the light directly emitted toward the front side with respect to the position where the illumination device 3 is provided, and typically, there is no need that the light directly emitted toward the front side exists. In this embodiment, the illumination device 3 is provided on an inner wall of the recessed portion 57*a* in the front side of the recessed portion 57*a*, and emits the light only toward substantially the rear side.

In this embodiment, an opening and closing operation is performed from the front side of the printer 1 in general. For that reason, in the case where the illumination direction of the light of the illumination device 3 is a direction (forward direction) from the rear side toward the front side, it would be considered that the light from the illumination device 3 enters the eye level of the operator and thus the operator does not readily visually recognize the grip 91. On the other hand, in this embodiment, the illumination direction of the light of the illumination device 3 is a rearward direction, and therefore the light from the illumination device 3 does not enter the eye level of the operator. As a result, the viewability of the grip 91 can be improved.

Thus, in the case where a sufficient space can be ensured in the front side of the grip 91, the illumination device 3 is disposed in the front side of the grip 91 and the light is emitted toward the front side, whereby the light can illuminate the position of the grip 91 without entering the eye level of the operator.

Other Embodiments

As described above, the present invention was described based on the specific embodiments, but is not limited to the above-described embodiments.

Further, in the above-described embodiments, the operating portion for the openable member was the grip operated for releasing (eliminating) locking for maintaining the openable member in the closed state, but is not limited thereto. The operating portion may also be a button pushed for releasing the locking. Further, the operating portion may also be, for example, a knob or a gripping portion (recessed portion or the like) which is provided so as to be easily operated by the operator when the operator opens and closes the openable member.

In the above-described embodiments, the option unit was connected with the side surface of the image forming apparatus from which the sheet is discharged, but the present invention is not limited thereto. For example, it would be considered that a sheet feeding device for feeding the sheet to the printer 1 is connected as the option unit so as to be adjacent to a right side side surface of the printer 1 shown in FIG. 1. Also in this case, an openable member, openable maintained even in a state in which the option unit is mounted to the printer 1 at the right-side side surface, for exposing, e.g., the sheet feeding paths and the feeding members of the sheet feeding portion 101 in the printer 1 is provided in some cases. Also in this case, by applying the present invention to the openable member, it is possible to obtain an effect similar to those in the above-described embodiments.

Further, in the above-described embodiments, the case where the openable member provided to the image forming apparatus is opened and closed for the jam clearance was described. For example, in the case where the option unit is connected adjacently to the side surface of the image forming apparatus from which the sheet is discharged, the operating portion, of the openable member, where the sheet feeding paths and the feeding members in the neighborhood of the sheet discharging portion are exposed becomes dark, and therefore the present invention is very effective. However, the present invention is not limited thereto, but can also be applied to an arbitrary openable member such as an openable member or the like which is opened and closed for exchanging replacement parts of the image forming apparatus and for cleaning an inside of the image forming apparatus and the like purpose.

Further, the illumination device may preferably be provided to the openable member since the illumination device can clarify the position of the operating portion and can illuminate the operating portion irrespective of the opening/closing state of the openable member. However, when the illumination device can illuminate the operating portion, the illumination device may also be provided in the apparatus main assembly side of the image forming apparatus or in the option unit side as desired.

That is, the image forming system typically includes the image forming apparatus for forming the image on the sheet and the post-processing device, to which the sheet on which the image is formed by the image forming apparatus and then which is discharged from the image forming apparatus is fed, connected detachably mountable to the image forming apparatus. Further, the image forming system can employ a constitution including the openable member, provided to the image forming apparatus, opened and closed in the space between the image forming apparatus and the post-processing device, the operating portion, provided on the openable member, operated for opening the openable member and the illumination device for illuminating the operating portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-023038 filed on Feb. 9, 2016, which is hereby incorporated by reference herein in its entirety.

What is claimed is:

1. An image forming apparatus comprising:

an image forming portion configured to form an image on a sheet;

a sheet feeding device configured to feed the sheet;

an openable member configured to be opened for exposing at least a part of a sheet feeding path of said sheet feeding device to an outside of said image forming apparatus;

an operating portion operated for opening said openable member;

a recessed portion provided on said openable member and defined by at least an upper surface; and a light emitting surface from which a light for illuminating said operating portion is emitted, wherein said light emitting surface is provided on said upper surface that defines said recessed portion.

2. An image forming apparatus according to claim 1, wherein an option unit said is mountable to said image forming apparatus, and wherein said openable member is openable in a state in which said option unit is mounted to said image forming apparatus, and is provided at a position that is darker in the state in which said option unit is mounted to said image forming apparatus than in a state in which said option unit is not mounted to said image forming apparatus.

3. An image forming apparatus according to claim 2, further comprising a controller capable of emitting the light from said light emitting surface when said option unit is mounted to said image forming apparatus.

4. An image forming apparatus according to claim 1, wherein when a jam of the sheet in said sheet feeding device is detected, said light emitting surface emits light.

5. An image forming apparatus according to claim 3, further comprising a controller configured to control said light emitting surface to emit light when a jam of the sheet in said sheet feeding device is detected.

6. An image forming apparatus according to claim 1, wherein said light emitting surface emits light downward, and wherein said operating portion is provided at a position illuminated with the light emitted downward by said light emitting surface.

7. An image forming apparatus comprising:

an image forming portion configured to form an image on a sheet;

a sheet feeding device configured to feed the sheet;

an openable member configured to be opened for exposing at least a part of a sheet feeding path of said sheet feeding device to an outside of said image forming apparatus;

an operating portion operated for opening said openable member;

a recessed portion provided on said openable member and defined by at least a first surface; and a light emitting surface from which a light for illuminating said operating portion is emitted, wherein said light emitting surface is provided on said first surface that defines said recessed portion, and said light emitting surface emits light toward a rear side of said image forming apparatus, and wherein said operating portion is provided at a position illuminated with the light emitted toward the rear side by said light emitting surface.

8. An image forming apparatus according to claim 1, wherein said operating portion is a grip operated for releasing a lock for maintaining said openable member in a closed state.

9. An image forming apparatus according to claim 1, wherein said openable member is opened and closed by being rotated about a rotation center provided so as to extend in a substantially gravitational direction.

10. An image forming apparatus according to claim 2, wherein said option unit is mountable to a side surface of a main assembly including said image forming portion, and wherein said openable member is provided at the side surface to which said option unit is mounted.

11. An image forming apparatus according to claim 10, wherein said sheet feeding device includes, as the sheet feeding path, a first path for discharging the sheet on which the image is formed by said image forming portion and a second path, branching from the first path, in which the sheet is pulled for turning upside down the sheet on which the image is formed by said image forming portion and for reversing leading and trailing ends of the sheet with respect to a feeding direction, and wherein said openable member forms at least a part of the second path.

12. An image forming apparatus according to claim 1, wherein said operating portion is provided on said openable member.

13. An image forming apparatus according to claim 1, wherein said openable member is provided inside said recessed portion.

14. An image forming apparatus according to claim 1, wherein said light emitting surface emits light downward, and wherein said operating portion is provided in said recessed portion.

* * * * *